US006077139A

United States Patent [19]

Celik

[11] Patent Number: 6,077,139

[45] Date of Patent: Jun. 20, 2000

[54] FLOATSTRIDER PADDLE FIN FORWARD PROPULSION SYSTEM

[76] Inventor: Richard J. Celik, 508 Arch Bridge Rd., Ghent, N.Y. 12075

[21] Appl. No.: 08/770,748

[22] Filed: Dec. 19, 1996

[51] Int. Cl.[7] ..... A63B 31/08

[52] U.S. Cl. ..... 441/64; 441/61

[58] Field of Search ..... 441/61, 62, 63, 441/64, 55, 130–132

[56] References Cited

U.S. PATENT DOCUMENTS

| | | | |
|---|---|---|---|
| 4,664,639 | 5/1987 | Schneider | 441/61 |
| 5,338,275 | 8/1994 | Chek | 441/64 |
| 5,531,621 | 7/1996 | Johnson | 441/61 |
| 5,593,333 | 1/1997 | Johnson | 441/63 |

*Primary Examiner*—Stephen Avila
*Attorney, Agent, or Firm*—Carl C. Kling

[57] ABSTRACT

The float tube paddle fin 1 includes a web 2 which has two edge-supporting rib sleeves 3 and a central fold-supporting rib sleeve 4, encapsulating ribs 5. There is an arch strap 6 sewn onto the width of the leading edge of web 2, with free ends extending outward from web 2. Attached at the juncture of the leading edge of the web 2 and the free ends of arch strap 6 is ankle strap 7 which has an adjustment buckle 7 at one free end. Also attached to outer tube sleeves 3, at intermediate points 9, is a heel strap 10, which has an adjustment buckle 8 at one free end. The trailing edge of web 2 is hemmed to seal the supporting rib sleeves 3 and 4. Ankle strap 7 and heel strap 10 bridge the web 2, and to support the web 2 so as to fit snugly against the arch of the foot of the floatstrider, and to trail easily through the water in a "V," like closed butterfly wings, as the foot strides forward, on dry land, on river bottom, or through deep water. However, as the floatstrider's foot moves backward, water pressure against the edges of web 2 opens the "V" and rotates the web 2 downward to exert maximum force forward and to propel the floatstrider and the float tube forward.

6 Claims, 4 Drawing Sheets

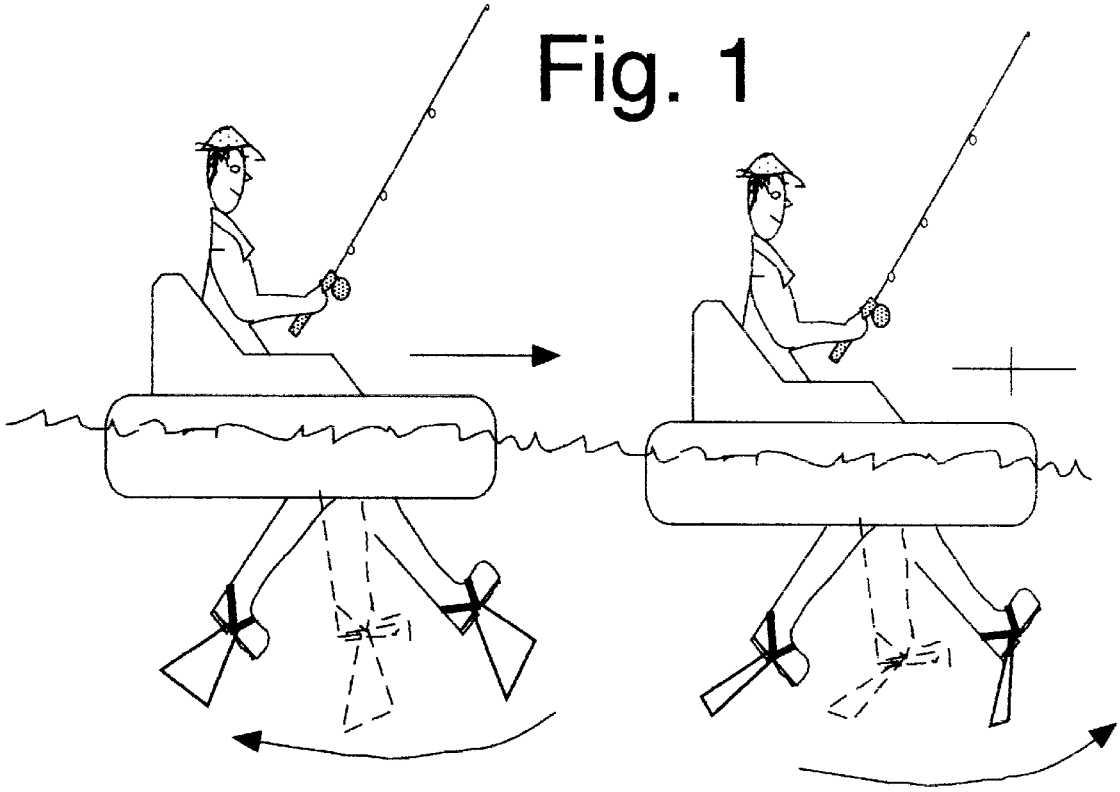
Fig. 1
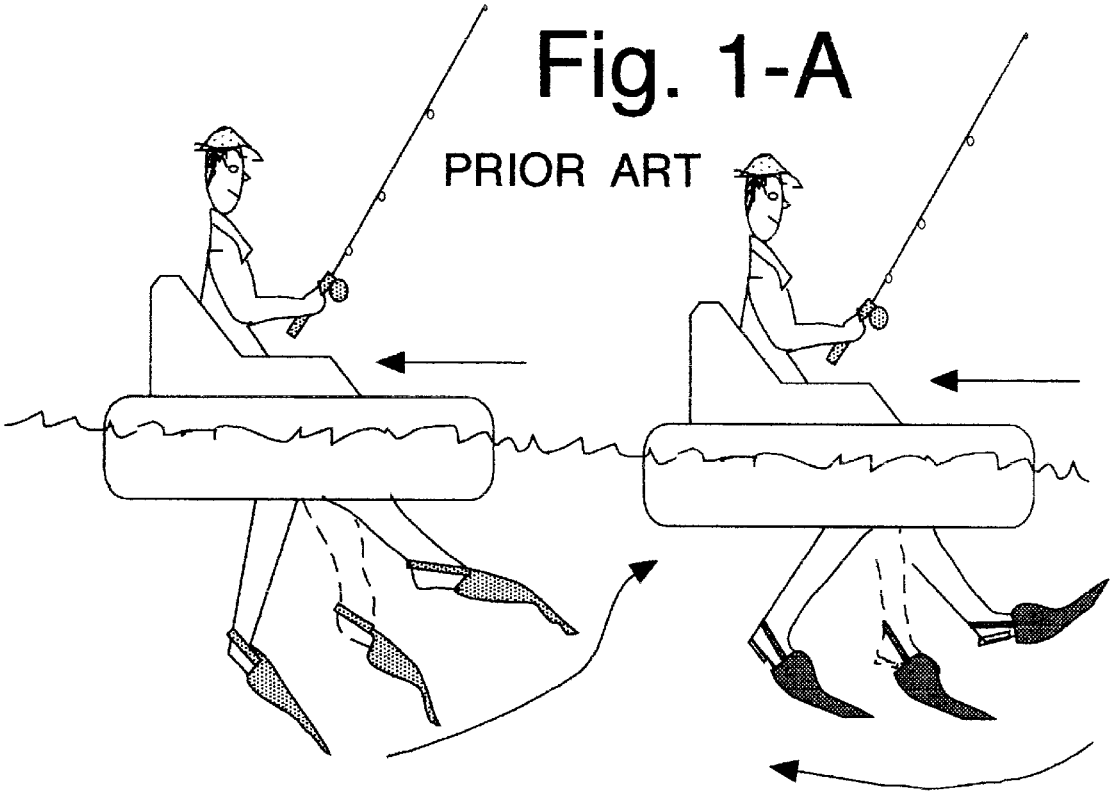
Fig. 1-A
PRIOR ART

FLOATSTRIDER PADDLE FIN FORWARD PROPULSION SYSTEM

TECHNICAL FIELD

The invention relates to paddle fins, and specifically relates to float tube paddle fins which propel a floatstrider forward instead of backward, and which permit safe walking on dry land or river bottom as well as free-floating propulsion without mechanical means or devices, and without adjustment during use.

BACKGROUND OF THE INVENTION

Traditionally, swim fins are used to assist a swimmer. Swim fins are most effective in the crawl stroke. Alternatively to swimming, float tubes, originally inner tubes from trucks, have been used for fishing. The float-tube- rider is seated, suspended in the center of the tube by a hammock-type of seat. While swim fins are quite useful in swimming, they leave a lot to be desired when used to propel a float tube. Since ordinary swim fins are not designed for this purpose of propelling a float tube, this unorthodox use of swim fins with float tubes presents many potential health hazards in the form of blind navigation, because the swim fins propel the float-tube-rider backwards. Other swim fin disasters caused by swim fins, which are semi-rigid in structure and are worn protruding from the toes, are:

falls while attempting to step into a float tube;

trip-up falls while walking on dry land or toward deep water.

On the surface, such falls may seem ludicrous. However, if such a fall should occur in shallow water there is a danger of drowning, or if such a fall should occur on dry land deep in the backwoods or in a swamp, far from help, there is a danger of life-threatening injury or exposure.

The float tube is a great relaxing way to scan a waterbody while fishing or observing nature. It travels downstream very easily as a sort of personal raft. However, when it comes to propulsion on a lake or pond, it is tricky and obstinate. When propelling the float tube while wearing conventional swim fins, the float-tube-rider must thrust the lower leg downward to take advantage of the swim fins. This being an abnormal maneuver, it results in considerable fatigue and pain to the complete leg and especially the foot—and creates frustration because it propels the float tube backwards!. The float-tube-rider not only gets sore legs, ankles and feet, but gets a sore neck and torso pain from constantly twisting to look back, over shoulder, to navigate the float tube. Making turns and maintaining position are also difficult maneuvers.

It is acknowledged that any type of swim fin provides more effective propulsion than plain feet, but the need persists for a comfortable, effective foot-propulsion mechanism which propels forward.

SUMMARY OF THE INVENTION

The object of the invention is to provide to a floatstrider a set of float tube paddle fins which are safe and easy to walk in on dry land or along a river bottom in shallow water, and which automatically converts a relaxed forward-striding motion of the floatstrider's legs to a forward propulsion of the float tube when in deep water.

A feature of the invention is a "V" shaped web which permits a low-resistance recovery stroke but opens out on the power stroke for maximum forward propulsion.

Another feature of the invention is a simple support system with arch strap, ankle strap and heel strap, attached to allow easy tracking of the web on land or shallow, water while automatically opening and rotating downward in deep water.

An advantage of the invention is that it permits, without any mechanical means or devices, without in-use adjustment, safe and easy striding on land and in shallow water as well as deep-water propulsion in the forward direction using a very similar striding gait.

Other objects, features and advantages of the invention will become apparent from the annexed drawings and written description showing a preferred embodiment.

FIGURES

FIG. 1 is a composite drawing showing the relaxed leg and foot attitudes of riders using floatstrider paddle fins as fishermen, one in front moving neither forward nor backward while in the recovery stroke, and the one behind him moving forward in a power stroke.

FIG. 1A is also a composite drawing showing the strain of extended legs and pointed feet, necessary when twin float-tube-riders are using conventional swim fins, one in front moving backwards while in the upward stroke, and the other one behind him also moving backwards in the downward stroke.

DETAILED DESCRIPTION OF A PREFERRED EMBODIMENT

FIG. 1 shows two floatstriders set up for fishing. Float-tube fishermen wear chest-high waterproof booted waders suits as shown. The float tubes may also have protective membranes and back supports to keep the floatstriders dry, sitting comfortably in their float tubes, moving their legs back and forth as though taking a leisurely walk. When a boot is brought forward in the recovery stroke, the natural force and weight of the water against the ribs and webbing of the floatstrider fin 1 collapses, closing the webbing, and yielding minimal resistance so as to provide minimum backward motion. The floatstrider in front is shown in the recovery stroke. The floatstrider in the rear is in the power stroke, in which the natural weight of the water against the ribs and webbing of the floatstrider fin 1 create a force to open the webbing and propel the float tube forward.

Figure 2:
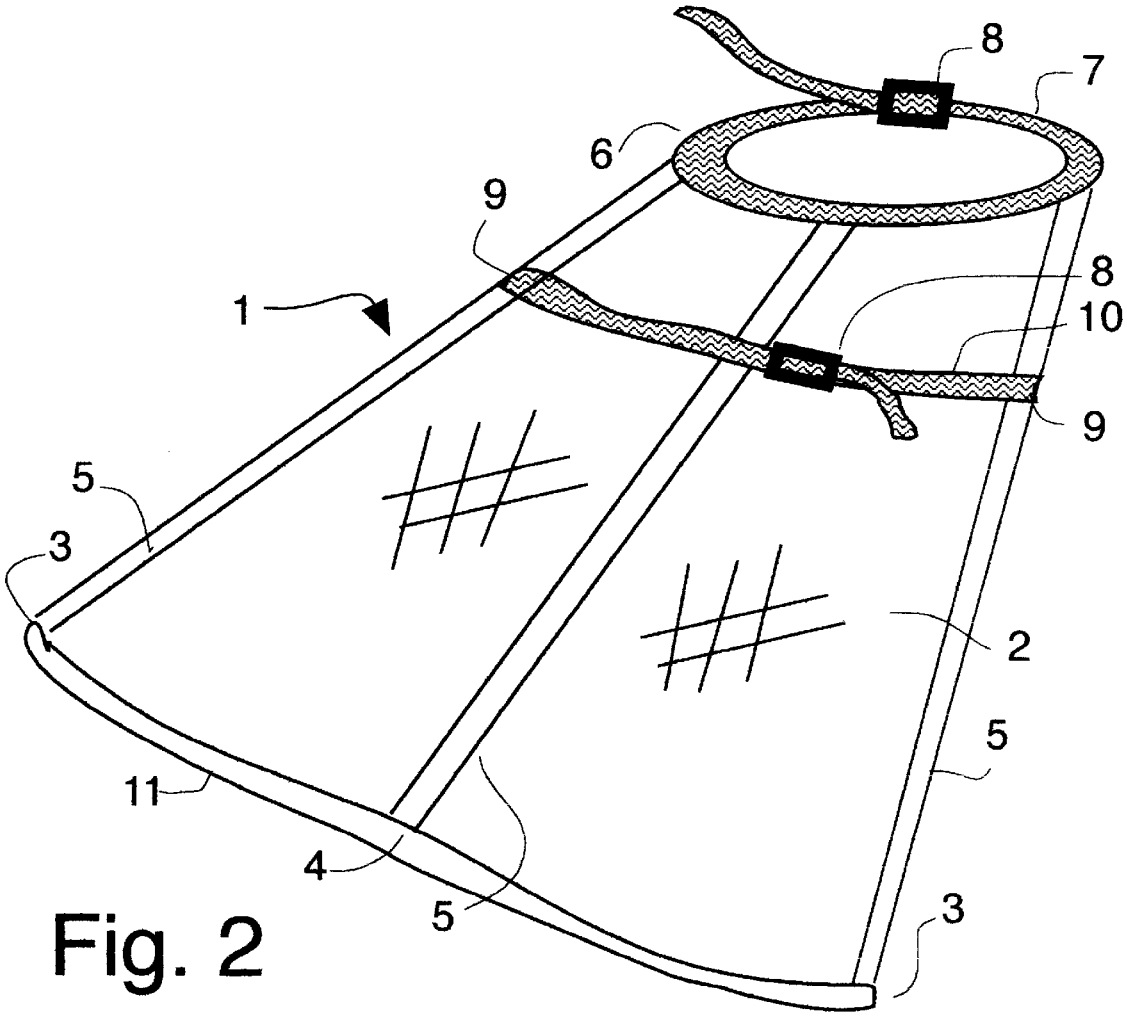
FIG. 2 is a plan view of the invention, showing web and support subsystems.
Figure 3:
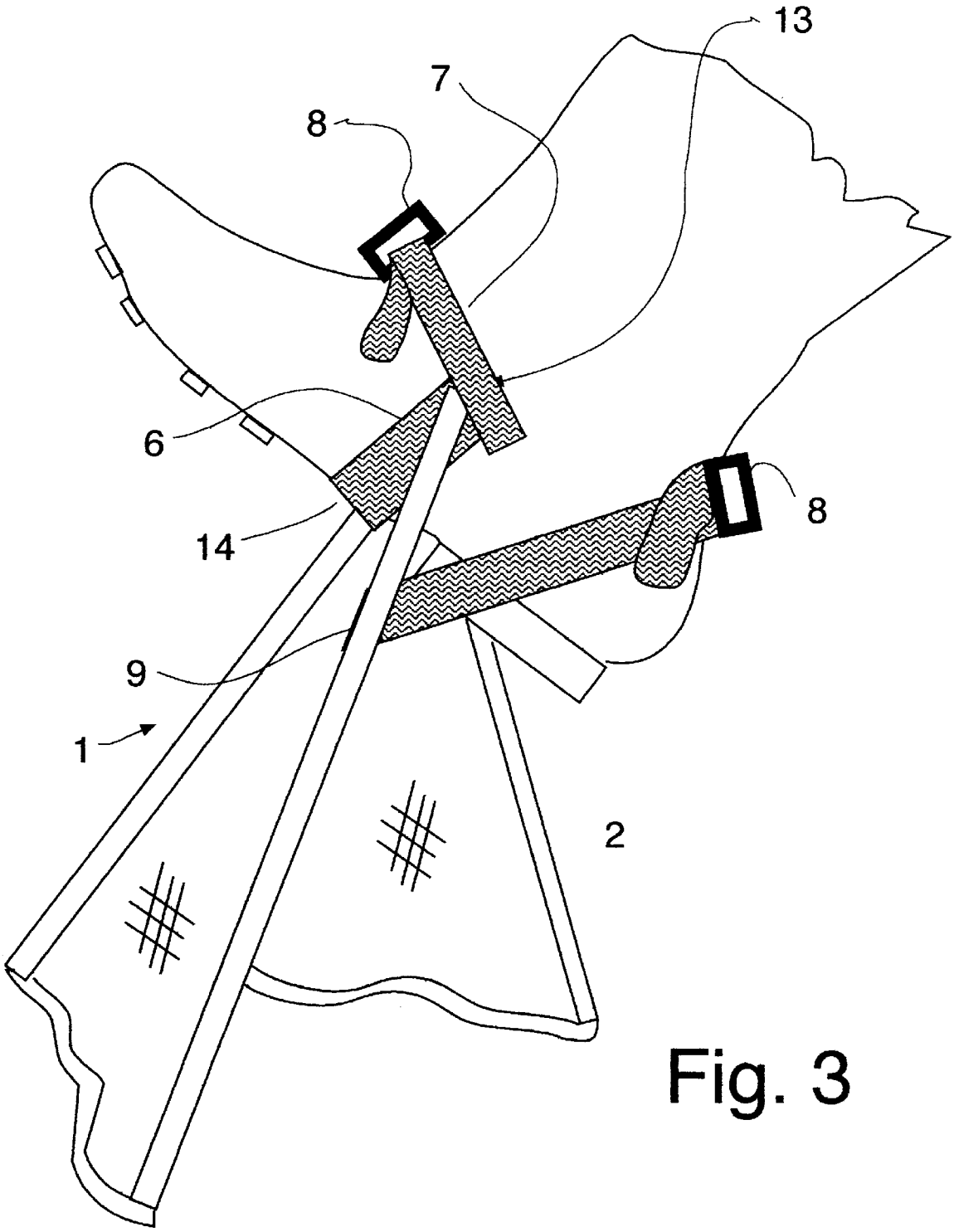
FIG. 3 is an underwater side elevation of the floatstrider's boot in the power stroke, with web 2 opened and rotated for maximum forward propulsion.
Figure 4:
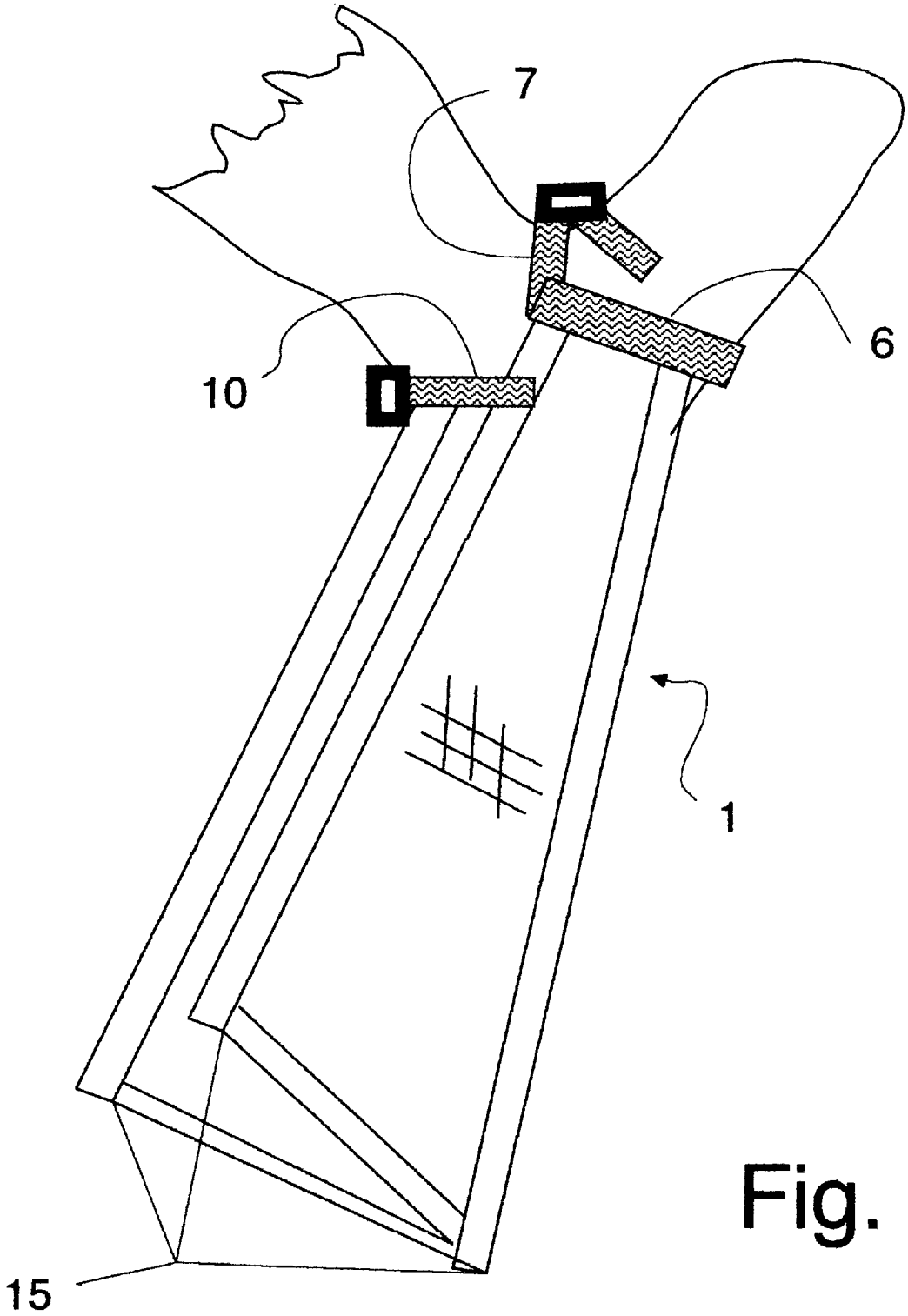
FIG. 4 is an underwater side elevation of the floatstrider's boot in the recovery stroke, with web 2 closed for minimum forward resistance in deep water—this is also the attitude when walling in shallow water and on land.

FIG. 1 will be further described after the floatstrider fin 1 is described with respect to FIGS. 2, 3 and 4. The floatstrider fin 1 includes flexible nylon fabric webbing material 2 with outside rib tube sleeves 3 and central rib tube sleeve 4, and also including polyvinylchloride tube ribs 5 and nylon web arch strap 6. The floatstrider fin 1 also includes a suspension system comprising nylon web ankle strap 7 with its buckle 8, which when tightened holds the floatstrider fin 1 closely to the arch of the floatstrider's boot. Without more, the floatstrider fin 1 would simply flop and find its easiest path through the water. Attached at intermediate points 9, however, is nylon web heel strap 10 with its buckle 8. The flexible nylon fabric webbing 2 is hemmed with the nylon web arch strap 6 sealing off the leading edges of the tube sleeves 3 and 4. The final ends of the nylon web ankle strap 7 are sewn at a ninety degree angle forward, onto the final ends of the nylon web arch strap 6. The supporting ribs 5 are slipped into the supporting rib sleeves 3 and 4 and sealed by hem 11, which seals the ends of the supporting rib sleeves as well as the trailing edge of the flexible nylon fabric webbing material 2.

FIG. 3 shows how the floatstrider fin 1 is attached to the boot, with straps 6, 7 and 10 all tightened in the power stroke.

FIG. 4 shows the floatstrider fin 1 in the recovery stroke position, with arch and ankle straps 6 and 7 still snug, but with heel strap 10 relaxed. This is also the attitude of floatstrider fin 1 when the wearer is walking in shallow water or on land.

Referring to FIGS. 1, 3 & 4 the floatstrider brings the foot forward in the recovery stroke. This movement of the floatstrider fin 1 pushes against the resistance of the water to close nylon fabric webbing material 2 and the supporting ribs 5 to pivot the floatstrider fin 1 simultaneously, at the flexible pivot points 13,14, forcing the wings of nylon fabric webbing material 2 closed. This positions the floatstrider fin 1 directly behind the heel, trailing the foot, as shown on the forward floatstrider of FIG. 1. The two outer supporting ribs 5 are held apart by the width of the foot, assuming a "V" configuration as shown by reference character 15 in FIG. 4. This hydrodynamic shape minimizes wing area on the recovery stroke and cuts through the water with minimal resistance. Due to this shape, the recovery stroke requires minimal effort on the part of the floatstrider, minimizing body and leg exertion and fatigue.

At the start of the power stroke, the "V" configuration 15 immediately initiates the opening of the floatstrider fin 1 wings. As the force of power against the resistance of the water opens the flexible nylon fabric webbing material 2, the supporting ribs 5 are spread open and are held from inverting by the nylon web heel strap 10. As the resistance of water becomes greater on the open wings of flexible nylon fabric webbing material 2, the trailing ends of the supporting ribs 4 and 5 are almost at right angles to the sole of the foot, as shown in FIG. 3. The continued power stroke positions the floatstrider fin 1 in an attitude that utilizes maximum wing area of flexible nylon webbing material 2 to propel the float tube forward through the water, with minimal energy wasted.

SUMMARY

Ordinary swim fins, which extend from the toes, propel a person backwards, much like rowing a rowboat, when the person is floating in a float tube in deep water. This is uncomfortable and inefficient. Ordinary swim fins are also dangerously cumbersome for a person walking with a float tube in shallow water or on dry land. Floatstrider fins according to this invention extend the insteps and heels, and propel a person, in a float tube, in a forward direction. The floatstrider fins 1 open up like butterfly wings on the power stroke and close like butterfly wings for the recovery stroke, without any mechanical means or devices. Arch straps 6, ankle straps 7 and heel straps 10 hold the floatstrider fins in place in deep water so that water pressure automatically opens the webbing material 2 for the power stroke and closes the webbing material 2 for the recovery stroke, in response to a striding motion by the person who is the floatstrider. In shallow water or on land, the floatstrider fin 1 webbing material 2 remains closed and follows safely and easily the striding motion by the person.

I claim:

1. An amphibious float tube paddle fin system for a floatstrider, whose soles and heels establish a base plane essentially perpendicular to their respective ankles, and whose intent is to be able to walk on dry land or to wade in shallow water, as well as to foot-paddle in a forward direction while suspended in a float-tube in water too deep for wading characterized by a) a self-supported fin (1) providing, as a recovery direction, an easy direction through the water with the fin in an attitude substantially parallel to said base plane, and being subject to a water-pressure operated rotation which provides as a power direction, a resistant direction through the water, substantially different from the easy direction, open against water pressure as the floatstrider makes a forward striding motion driving heel backward with respect to body; and b) a support system for affixing said fin (1) to the ankle of such floatstrider, establishing the easy direction substantially tracking the heel of such floatstrider along said base plane, and establishing, the power direction with substantial strength as water pressure rotates said fin (1) so as to be essentially perpendicular to said base plane during a power stroke in the form of a relative backward motion of the respective heel with respect to the body of said floatstrider;

said support system comprising an arch strap (6), an adjustable ankle strap (7) and an adjustable heel strap (9), arranged in concert to support said fin (1) as it opens to track easily behind the heel on the recovery stroke and closes to track with maximum resistance to backward motion of the heel through the water during the power stroke; further characterized in that:

said fin (1) has a support end connected to said support system at said arch strap (6) and to said adjustable ankle strap (7) and has an intermediate connection for said heel strap (9), which permits said fin (1) to rotate between a recovery direction essentially coplanar with the sole plane and a power direction essentially perpendicular to the sole plane, without alteration of strap adjustments.

2. An amphibious float tube paddle fin system for a floatstrider, according to claim 1, further characterized in that:

said arch strap (6) seals off the support end of said fin (1) against the sole of the floatstrider's footgear.

3. An amphibious float tube paddle fin system for a floatstrider, according to claim 2, further characterized in that:

said arch strap (6) acts as a pivot for said fin (1) to move in an arc not greater than 90 degrees.

4. An amphibious float tube paddle fin system for a floatstrider, according to claim 2, further characterized in that:

said arch strap (6) acts as a pivot for said fin (1) to move in an arc of 80 degrees.

5. An amphibious float tube paddle fin system for a floatstrider, according to claim 2, further characterized in that:

said ribs (3,5) are tubular rods of material of the group (plastic, fiberglass and aluminum).

6. An amphibious float tube paddle fin system for a floatstrider, whose soles and heels establish a base plane essentially perpendicular to their respective ankles, and whose intent is to be able to walk on dry land or to wade in shallow water, as well as to foot-paddle in a forward direction while suspended in a float-tube in water too deep for wading characterized by a) a fin subsystem having two multiple-rib fins (1), each foldable about a central axis, each of said fins (1) including; a web (2) and (6 –10) at least two outside ribs (3) and a central rib (5), providing, as a recovery direction, an easy direction through the water with the fin folded about said central rib, and having a water-pressure operated opening (15) which provides, as a power direction, a resistant direction through the water, opposite the easy direction, unfolded open with ribs providing strength against water pressure as the floatstrider makes a forward striding motion; and b) a support subsystem (6–10) for affixing said fin subsystem to the foot of such floatstrider, establishing the easy direction substantially tracking the heels of such floatstrider along said base plane, and establishing the power direction with substantial strength parallel to said base plane, as water pressure rotates said fin so as to be essentially perpendicular to said base plane during a power stroke in the form of a relative backward motion of the respective heel with respect to the body of said floatstrider.

* * * * *